US006640520B2

(12) United States Patent
Gecic

(10) Patent No.: US 6,640,520 B2
(45) Date of Patent: Nov. 4, 2003

(54) APPARATUS AND METHOD FOR ROLL PACKING COMPRESSIBLE MATERIALS

(75) Inventor: Josip Gecic, Koprivnica (HR)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 10/066,905

(22) Filed: Oct. 22, 2001

(65) Prior Publication Data

US 2003/0074864 A1 Apr. 24, 2003

(51) Int. Cl.[7] ..... B65B 63/04

(52) U.S. Cl. ..... 53/430; 53/114; 53/118; 242/571

(58) Field of Search ..... 53/430, 118, 114; 242/575.3, 571.6, 571

(56) References Cited

U.S. PATENT DOCUMENTS

| | | | | | |
|---|---|---|---|---|---|
| 1,144,697 | A | | 6/1915 | Delaney | |
| 2,114,008 | A | | 4/1938 | Wunderlich | |
| 2,311,383 | A | * | 2/1943 | Hardenberg | 242/575.3 |
| 3,122,089 | A | | 2/1964 | Sinclair | |
| 3,129,658 | A | | 4/1964 | Valente | |
| 3,270,976 | A | * | 9/1966 | Smith | 242/571.6 |
| 3,521,424 | A | | 7/1970 | Wirfel | |
| 3,927,504 | A | | 12/1975 | Forrister | |
| 3,964,232 | A | * | 6/1976 | Bender et al. | 53/430 |
| 4,109,443 | A | | 8/1978 | Findlay | |
| 4,377,262 | A | | 3/1983 | Zajac | |
| 4,385,478 | A | * | 5/1983 | Veerkamp | 53/118 |
| 4,507,947 | A | * | 4/1985 | Stanley | 72/130 |
| 4,532,750 | A | * | 8/1985 | Meier | 53/118 |
| 4,550,550 | A | * | 11/1985 | Scott | 53/529 |
| 4,711,067 | A | | 12/1987 | Magni | |
| 4,775,111 | A | * | 10/1988 | Kalin | 242/528 |
| 4,967,536 | A | | 11/1990 | Reist | 53/118 |
| 5,101,610 | A | | 4/1992 | Honegger | 53/430 |
| 5,121,584 | A | * | 6/1992 | Suter | 53/116 |
| 5,495,700 | A | * | 3/1996 | Stauber et al. | 53/118 |
| 5,765,343 | A | | 6/1998 | Whittaker | 53/430 |
| 5,934,041 | A | | 8/1999 | Rudolf et al. | |
| 5,934,046 | A | * | 8/1999 | Whittaker | 53/430 |
| 6,098,378 | A | | 8/2000 | Wyatt | |
| 6,260,782 | B1 | * | 7/2001 | Smithson et al. | 242/379.1 |
| 6,357,209 | B1 | | 3/2002 | Mossbeck et al. | 53/430 |
| 6,467,239 | B2 | * | 10/2002 | Mossbeck et al. | 53/430 |

* cited by examiner

*Primary Examiner*—Eugene Kim
*Assistant Examiner*—Christopher R Harmon
(74) *Attorney, Agent, or Firm*—Wood, Herron & Evans, L.L.P.

(57) ABSTRACT

An apparatus and method for roll packing a variety of compressible materials including a radially collapsible mandrel for easy removal of the roll packed material without tearing or telescoping of the material. The apparatus further includes an adjustable compression roller for setting the amount of compression in the rolled material and a roll handling device that facilitates removal of finished rolls from the apparatus. In one embodiment of the invention, a packing material dispenser supplies packing material to the in-fed compressible material as it is wound upon the mandrel.

18 Claims, 3 Drawing Sheets

APPARATUS AND METHOD FOR ROLL PACKING COMPRESSIBLE MATERIALS

FIELD OF THE INVENTION

This invention relates to the packaging of compressible materials such as foam and spring assemblies used in the manufacture of mattresses and the like, and is more particularly directed to an apparatus for packaging such compressible materials into a roll.

BACKGROUND OF THE INVENTION

Conventional packaging and transportation of compressible materials such as finished mattresses, as well as foam or spring assemblies used in the manufacture of mattress products, generally involves handling of the materials in an uncompressed state. As such, the shipping and storage of the materials requires much more space than would be required if the materials were provided in a compressed state. To improve the efficiency of shipping and storage, foam mattress cores have been packaged in a compressed state by flattening the foam and sealing it in an evacuated bag. See, for example, U.S. Pat. No. 4,711,067 to Magni. This method of packaging foam cores, however, is not useful in packaging spring assemblies. In addition, storage and transportation efficiencies of the foam could be further improved by packaging the flattened cores into a tight roll.

Roll packing generally involves winding-up a desired material to form a roll and then securing the roll to prevent uncoiling of the roll during handling. In the case of compressible materials such as mattresses and foam or spring cores, it is often desired to compress the materials during the roll packing process to obtain a more dense and compact roll. Various devices have been used to achieve compression of roll packed materials. U.S. Pat. No. 3,927,504 to Forrister discloses an apparatus for rolling resilient foamed sheet material without the use of a mandrel. This machine is not useful for packaging spring assemblies and does not have the capability to package multiple units of a compressible material into a large roll. The device further does not provide for packaging a compressible material with a barrier layer between successive turns of the roll, which barrier layer is desirable to prevent adhesion between successive layers of foam.

Some roll packing systems further include a mandrel for facilitating the winding of the material. For example, U.S. Pat. No. 2,114,008 to Wunderlich discloses a spring packing machine having a radially collapsible arbor for use in roll packing spring assemblies. A barrier layer between successive turns of the roll keeps the spring assemblies separate and permits easy removal of a single assembly from the roll. However, this machine is not useful for roll packing foam material due to the presence of a pressure bar 50, between belt 15 and the collapsible arbor, which would tend to snag a compressed foam as it passed beneath. The disclosed machine also has other drawbacks. For example, to remove a finished roll, the arbor must be removed from the machine and collars must be adjusted to collapse the arbor so that the roll can be taken off the arbor. The arbor must then be replaced in the machine before another roll can be formed. Operation of the machine is thus very labor intensive and ergonomically inefficient.

There is thus a need for a simple apparatus capable of roll packing multiple units of various compressible materials, such as foam mattress cores, mattress spring assemblies, and finished mattress products and which is ergonomically efficient and is capable of providing a barrier layer between successive turns of a formed roll.

SUMMARY OF THE INVENTION

The present invention provides a simple machine for roll packing a variety of compressible materials such as foam cores, spring assemblies, and fiber materials used in the manufacture of mattress products, as well as finished mattresses themselves. The machine has a radially collapsible mandrel that permits finished roll packed materials to be easily removed from the machine by sliding the roll off of the mandrel. This radially collapsible mandrel permits rolled materials to be removed without any telescoping or tearing of the materials which is usually caused by binding of the roll packed material on the mandrel. The machine of the present invention is especially useful in roll packing foam materials which are highly susceptible to binding against a mandrel. The simplicity of design of the machine of the present invention further permits use in roll packing practically any compressible material, even materials as diverse as coiled spring assemblies for mattresses and foam cores.

In accordance with the present invention, an apparatus is provided having a radially collapsible mandrel for winding compressible materials to be roll packed. A feed table is provided upstream of the mandrel to support and direct the compressible material to the mandrel. A packing material dispenser is further provided proximate the mandrel to feed packing material to the mandrel with the compressible material. A compression roller associated with the mandrel is used to compress in-fed compressible materials between the compression roller and the mandrel as the material is being wound upon the mandrel. The compression roller is adjustable to vary the spacing between the mandrel and the compression roller so that the amount of compression for the in-fed materials can be varied accordingly. In one exemplary embodiment, a pneumatic cylinder is used to adjust the position of the compression roller relative to the mandrel. The mandrel is driven at one end by a driving mechanism including, for example, a motor and a gearbox, and has a bearing plate at the opposite end. The bearing plate is movable away from the end of the mandrel so that a finished roll of material can be easily pushed off of the mandrel after it has been collapsed. In another exemplary embodiment, the apparatus includes a stripper bar associated with the mandrel to facilitate the removal of finished rolls from the mandrel, and further includes a roll handler for receiving the finished roll as it is pushed off the mandrel.

In further accordance with the present invention, a method for roll packing various compressible materials includes the steps of providing a collapsible mandrel and a compression roller, directing in-fed compressible materials between the mandrel and compression roller, adjusting the spacing between the mandrel and compression roller, winding the compressible material around the mandrel, stopping the mandrel when a desired amount of in-fed material has been wound upon the mandrel, collapsing the mandrel, and removing the roll packed material from the mandrel. A method for roll packing foam materials, in particular, in accordance with the present invention is disclosed in U.S. patent application Ser. No. 09/986,227, entitled "Method for Roll Packing Foam Cores," filed on even date herewith, assigned to the assignee of this application, and incorporated by reference herein in its entirety.

Accordingly, the invention provides a simple apparatus and method for roll packing a variety of compressible materials and which has a collapsible mandrel that facilitates the easy removal of finished rolls without tearing, telescoping, or otherwise damaging the roll packed material. These and other objects and advantages of the present invention shall be made apparent from the accompanying drawings and description.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

An apparatus and method are provided for roll packing compressible materials in a simple and efficient manner without damaging the materials, and wherein the materials can be stored and shipped in a compact state. The present invention may be described and understood by a description of an exemplary apparatus.

Figure 1:
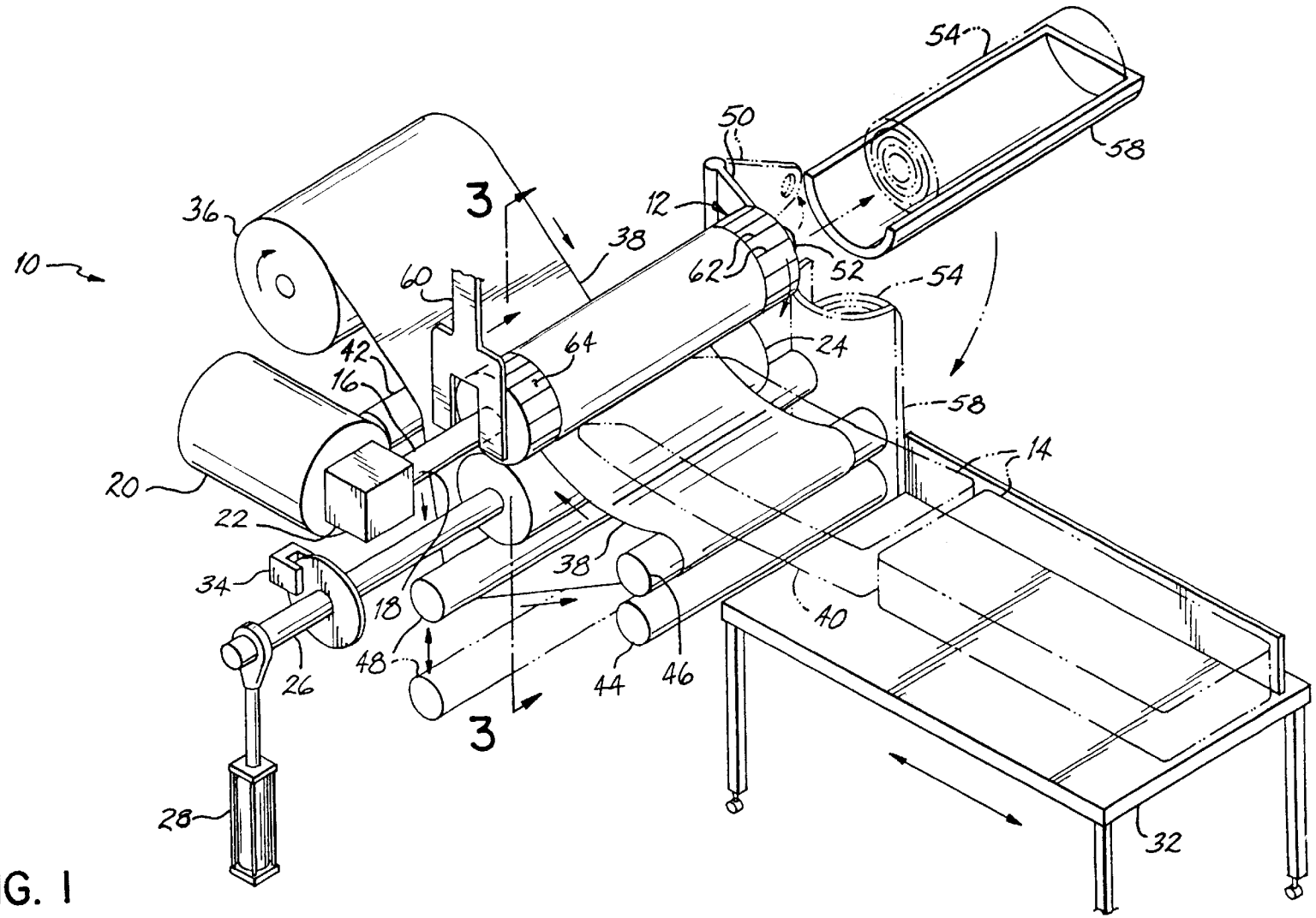
FIG. 1 is a perspective view showing a roll packing apparatus according to the principles of the present invention.

With reference to FIG. 1, there is shown an illustration of one embodiment of roll packing apparatus 10 incorporating the principles of the present invention. The apparatus 10 includes a collapsible mandrel 12 for receiving in-fed materials 14 and winding them into a roll. The mandrel 12 is fixed to a shaft 16 that is driven at a first end 18 by a driving mechanism, for example motor 20 and gearbox 22 connected to the shaft 16. The invention further includes a compression roller 24, which is located proximate the mandrel 12 and which is fixed to a compression roller shaft 26 that is substantially parallel to the mandrel shaft 16. Thus, the rotational axis of mandrel 12 is substantially parallel to the rotational axis of compression roller 24. The compression roller 24 is adjustable such as by means of an actuator 28 fixed to the roller shaft 26 whereby the spacing 30 (see FIG. 2) between the compression roller 24 and the mandrel 12 may be adjusted to vary or maintain the amount of compression on the in-fed materials 14. A feed table 32 located upstream of the mandrel 12 and compression roller 24 directs in-fed compressible materials 14 between the mandrel 12 and compression roller 24 as the material 14 is wound upon the mandrel 12. In one example of the present invention, not shown, the feed table 32 includes a jig plate to ensure proper alignment of the in-fed materials 14 with respect to the mandrel 12 and compression roller 24. A disc brake 34 may be attached to the roller shaft 26 to control rotation of the compression roller 24.

The apparatus 10 further includes a packing material dispenser 36 which supplies packing material 38, such as paper, plastic or fiber material, to a surface 40 of the in-fed compressible materials 14 as they are fed through the mandrel 12 and compression roller 24. The packing material is then wound with the compressed in-fed material to create a barrier layer between successive turns of the rolled material. In this manner, the barrier layer protects successive layers of in-fed material such as foam and prevents adhesion of the successive layers. The packing material dispenser 36 may further include a guide roller 42, pinch rollers 44, 46, and a tension roller 48 to aid in directing packing material 38 to the in-fed compressible material 14 and also to maintain proper tension and alignment of the packing material 38.

A bearing plate 50 is located at a second end 52 of the mandrel shaft 16, opposite the drive motor 20, and is movable to expose an end of the mandrel 12 so that a finished roll of material 54 may be removed from the mandrel 12. The invention further includes a roll handler 58 for facilitating easy removal of the finished rolls 54. In the exemplary embodiment of FIG. 1, the roll handler 58 is a trough-shaped cradle that is pivotally connected to a support (not shown) and can be placed in a first position near the end of the mandrel 12 for receiving a finished roll of material 54. A stripper bar 60 associated with the mandrel 12 aids in removing a finished roll 54 from the collapsed mandrel 12 onto the roll handler 58. The roll handler 58 may then be placed in a second position (shown in phantom) to permit operators to subsequently remove the roll 54 from the machine 10.

Figure 2:
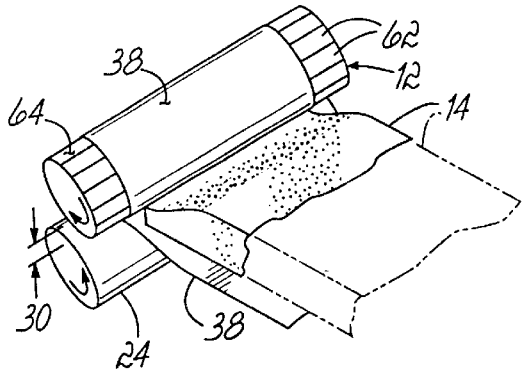
FIG. 2 shows detail of the mandrel and compression roller of the apparatus of FIG. 1, where an in-fed material is being compressed between the mandrel and compression roller.
Figure 3:
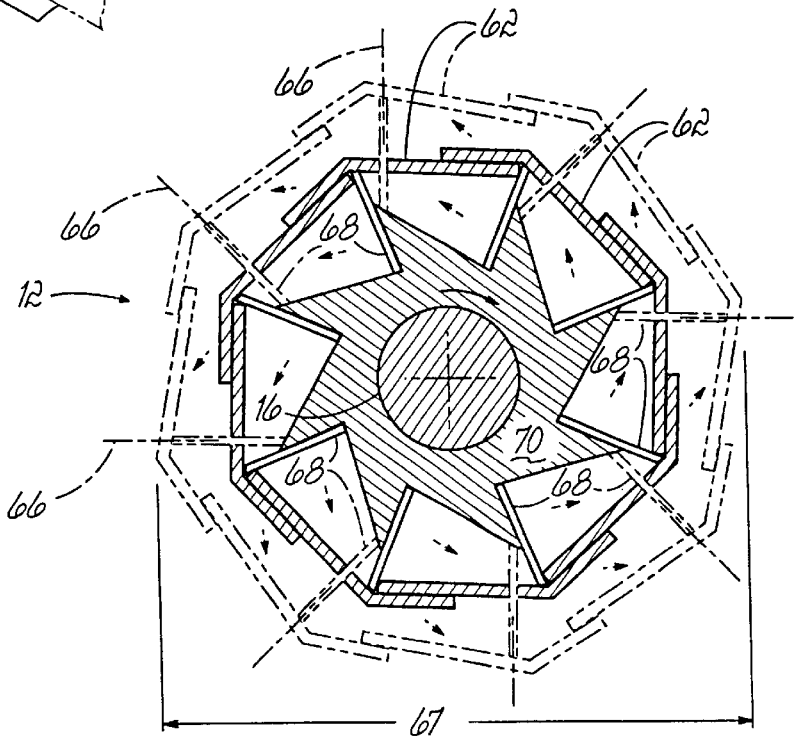
FIG. 3 shows a cross-sectional view of the mandrel of the present invention, taken along line 3—3, showing the collapsed state of the mandrel in solid lines and the expanded state of the mandrel in dashed lines.

As depicted more fully in FIGS. 2 and 3, the collapsible mandrel 12 may include a series of elongated plates 62 attached to the mandrel shaft 16 and positioned about the shaft 16 in an overlapping arrangement to create a substantially tubular surface 64 along the length of the shaft 16. The plates 62 are slidably connected to the shaft 16 and may move toward or away from the shaft 16 along radially extending paths 66 to increase or decrease the diameter 67 of the tubular surface 64 formed by the overlapping plates 62. Rods 68 connected to each plate 62 engage a cam 70 attached to the shaft 16, whereby rotational operation of the cam 70 causes the plates 62 to move either toward or away from the shaft 16 to correspondingly collapse or expand the mandrel diameter 67.

Figure 4A:
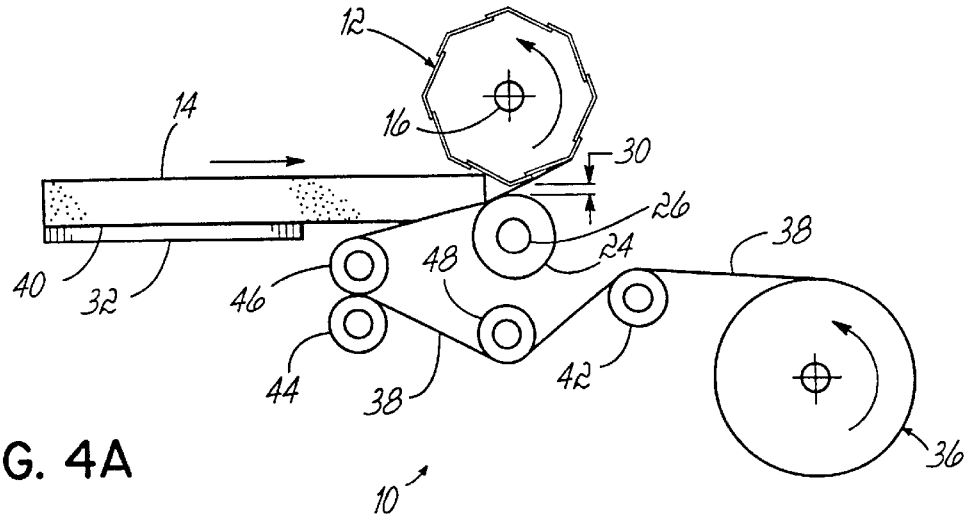
FIG. 4A is a partial side-view of the apparatus of FIG. 1, depicting the start of a winding operation with an expanded mandrel.
Figure 4B:
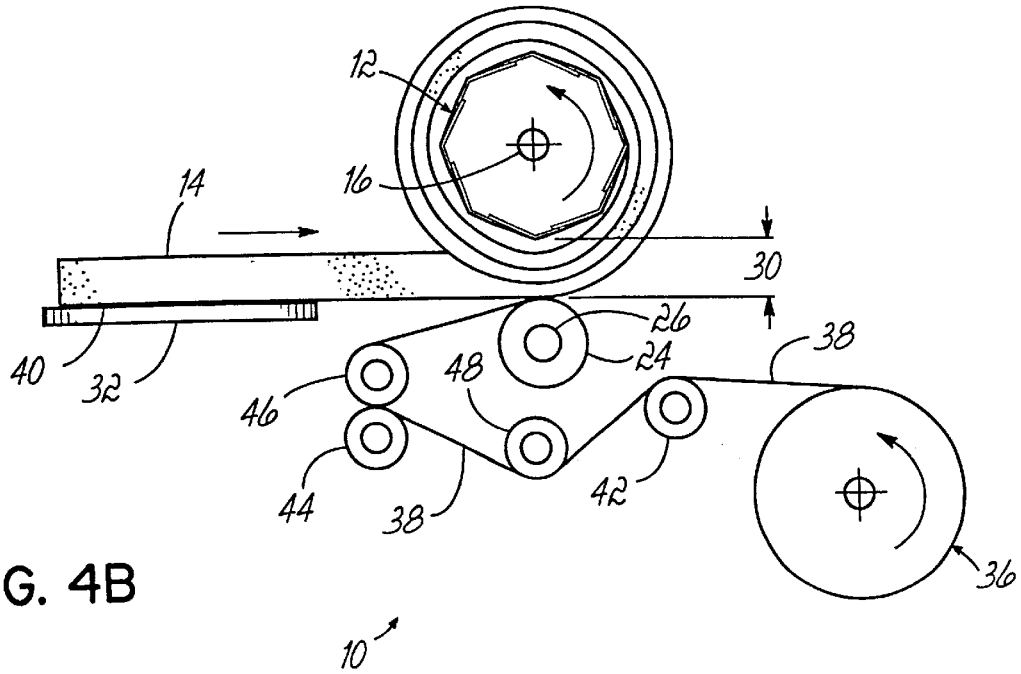
FIG. 4B shows the partial side-view of the apparatus of FIG. 1, depicting a partially wound roll on the expanded mandrel.
Figure 4C:
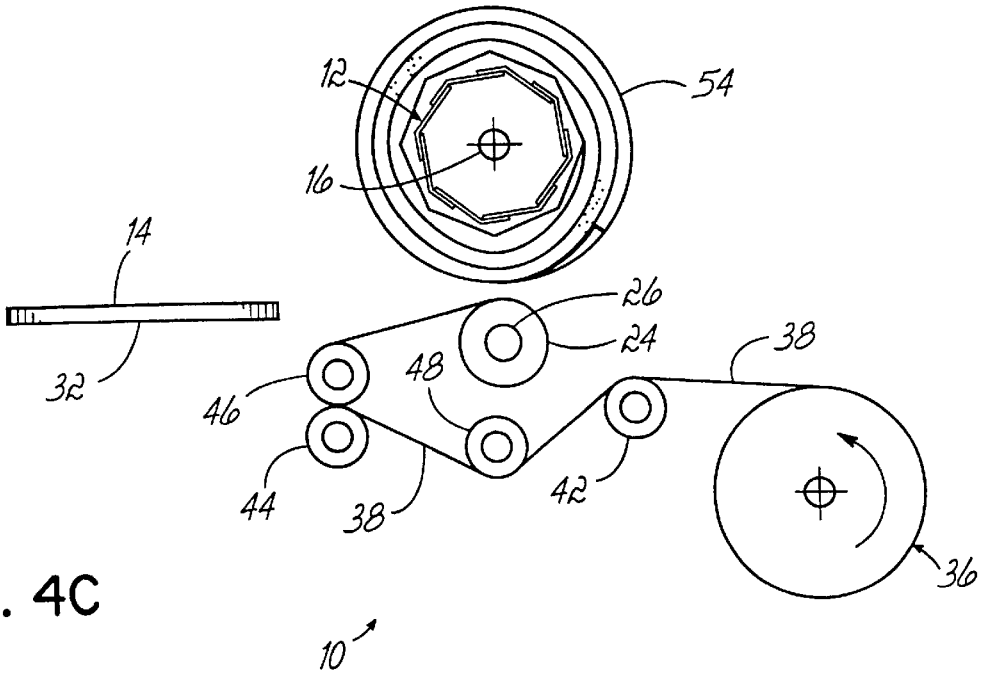
FIG. 4C shows the partial side-view of the apparatus of FIG. 1, depicting a fully wound roll and the mandrel in its collapsed state.

Referring to FIGS. 4A–4C, the method of the present invention, as it relates to operation of the exemplary apparatus 10 of FIGS. 1–3, will be described. The spacing 30 between the mandrel 12 and compression roller 24 is adjusted to provide a desired amount of compression in the in-fed compressible material 14. Packing material 38 from the packing material dispenser 36 is fed through the guide roller 42, pinch rollers 44, 46, and tension roller 48 and then directed between the compression roller 24 and mandrel 12 while the mandrel 12 is turned to wind an initial length of packing material 38 upon the mandrel 12, as depicted in FIG. 4A. In-fed compressible material 14, which is supported on feed table 32, is directed between the mandrel 12 and compression roller 24. The motor 20 (FIG. 1) is started and the mandrel 12 rotates to wind up the in-fed compressible material 14 and packing material 38 as it is compressed between the mandrel 12 and compression roller 24. The actuator 28 (FIG. 1) attached to the compression roller shaft 26 may be operated to vary the spacing 30 between the mandrel 12 and compression roller 24 as the roll 54 gets bigger, as can be seen in FIG. 4B, to maintain uniform compression in the roll 54. When a sufficient amount of compressible material 14 has been wound upon the mandrel 12, the motor 20 is stopped. The finished roll 54 is secured, for example, with tape, straps, or other suitable material, and bearing plate 50 (FIG. 1) is moved to expose an end of the mandrel 12. The mandrel 12 is then collapsed, as depicted in FIG. 4C, so that the finished roll 54 may be removed from the mandrel 12 under the operation of the stripper bar 60 (FIG. 1). The stripper bar 60 pushes the finished roll 54 into the roll handler 58 (FIG. 1) and the roll handler 58 then pivots to a second position so that operators can maneuver the finished roll 54 away from the machine 10.

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of applicant's general inventive concept.

What is claimed is:

1. An apparatus for roll packing compressible material, comprising:

an elongated, radially collapsible mandrel, the mandrel having a rotational axis along its length, whereby material may be wound upon the mandrel by rotating the mandrel, the mandrel having an adjustable diameter;

a compression roller operatively associated with said mandrel and having a rotational axis substantially parallel to the rotational axis of the mandrel, the compression roller being adjustable to vary its spacing relative to the mandrel, whereby in-fed material may be compressed between the compression roller and the mandrel as it is being wound upon the mandrel;

a drive mechanism operatively connected to a first end of the mandrel to turn the mandrel about its rotational axis;

a packing material dispenser proximate the mandrel for receiving and dispensing packing material to the compressible material as it is being wound upon the mandrel;

a support bearing located at a second end of the mandrel, opposite the first end, the support bearing being moveable to expose the second end of the mandrel to allow removal of a roll of material from the mandrel; and a stripper bar proximate the mandrel and configured to engage a roll of material on the mandrel and push the material toward the second end and off of the mandrel.

2. The apparatus of claim 1, further including a disk brake operatively connected to the compression roller to control the rotation of the compression roller about its rotational axis.

3. The apparatus of claim 1, further including a pneumatic cylinder operatively connected to the compression roller to adjust the position of the compression roller relative to the mandrel and thereby control the spacing between the mandrel and the compression roller.

4. The apparatus of claim 1, further including at least one feed roller associated with the packing material dispenser to provide even tension on the packing material and to direct the packing material from the dispenser to the in-fed compressible material as it is being wound upon the mandrel.

5. The apparatus of claim 1, further including a feed table upstream of the mandrel for supporting the compressible material and directing the compressible material between the mandrel and compression roller.

6. The apparatus of claim 5, wherein the feed table includes a jig plate for aligning the mandrel relative to the mandrel.

7. The apparatus of claim 1, further including a roll handler proximate the second end of the mandrel and configured to receive a roll of material from the mandrel and reposition the roll relative to the apparatus for subsequent processing.

8. An apparatus for roll packing compressible material, comprising:

an elongated, radially adjustable mandrel having a rotational axis along its length, the mandrel including a shaft, a plurality of elongated, overlapping plates movably connected to the shaft and radially disposed about the shaft to form a substantially tubular surface, and a cam fixed to the shaft and configured to move the plates toward or away from the shaft along paths extending radially from the shaft;

a compression roller operatively associated with said mandrel and having a rotational axis substantially parallel to the rotational axis of the mandrel, the compression roller being adjustable to vary its spacing relative to the mandrel, whereby in-fed material may be compressed between the compression roller and the mandrel as it is being wound upon the mandrel;

a drive mechanism operatively connected to a first end of the mandrel to turn the mandrel about its rotational axis;

a packing material dispenser proximate the mandrel for receiving and dispensing packing material to the compressible material as it is being wound upon the mandrel;

a feed table upstream of the mandrel for supporting the compressible material and directing the compressible material between the mandrel and compression roller;

a support bearing located at a second end of the mandrel, opposite the first end, the support bearing moveable to expose the second end of the mandrel to allow removal of a roll of material from the mandrel;

a stripper bar proximate the mandrel and configured to engage a roll of material on the mandrel and push the material toward the second end and off of the mandrel; and a roll handler proximate the second end of the mandrel and configured to receive a roll of material from the mandrel and reposition the roll relative to the apparatus for subsequent processing.

9. The apparatus of claim 8 wherein the feed table includes a jig plate for aligning the material relative to the mandrel.

10. The apparatus of claim 8 further including a disk brake operatively connected to the compression roller to control the rotation of the compression roller about its rotational axis.

11. The apparatus of claim 8 further including a pneumatic cylinder operatively connected to the compression roller to adjust the position of the compression roller relative to the mandrel and thereby control the spacing between the mandrel and the compression roller.

12. The apparatus of claim 8 further including at least one feed roller associated with the packing material dispenser to provide even tension on the packing material and to direct the packing material from the dispenser to the in-fed compressible material as it is being wound upon the mandrel.

13. The apparatus of claim 8 wherein the roll handler is an elongated, trough-shaped cradle pivotally mounted at a first end to a support, whereby the cradle may be placed in a first position to be substantially aligned with the mandrel to receive a finished roll from the second end of the mandrel, and whereby the cradle may be pivoted to a second position to permit subsequent handling of the finished roll.

14. A method of roll packing a compressible material in a roll packing machine having a radially collapsible mandrel, a compression roller proximate the mandrel and adjustable to vary the spacing therebetween, a stripper bar, a roll handler proximate the mandrel, and a packing material dispenser, the method comprising the steps of:

providing the mandrel in a non-collapsed position;

adjusting the spacing between the compression roller and the mandrel to obtain a desired compression of the compressible material;

winding packing material from the packing material dispenser onto the mandrel;

directing compressible material between the mandrel and the compression roller such that compressible material can be wound upon the mandrel by rotating the mandrel;

rotating the mandrel to wind the compressible material onto the mandrel;

applying packing material to the compressible material as it is wound upon the mandrel;

stopping rotation of the mandrel when a desired quantity of compressible material has been wound onto the mandrel;

collapsing the mandrel;

positioning the roller handler at an end of the mandrel:

pushing the finished roll off of the mandrel and into the roll handler using the stripper bar.

15. The method of claim 14 further including the step of securing the roll of compressible material, prior to removal from the mandrel, to prevent unrolling.

16. An apparatus for roll packing compressible mattress material, the apparatus comprising:

an elongated, radially collapsible mandrel supported by at least one support bearing, the mandrel having a rotational axis along its length, whereby mattress material may be wound upon the mandrel by rotating the mandrel, wherein the outer surface is adjustable to increase or decrease an outer diameter of the mandrel;

means for adjusting the amount of compression of the compressible mattress material as it is being wound upon the mandrel;

means for directing compressible mattress material between the mandrel and the compressing means so that the compressed mattress material may be wound upon the mandrel;

means for dispensing and applying packing material to successive layers of the compressible mattress material as it is wound upon the mandrel; and means for removing the roll of compressible mattress material from the collapsed mandrel.

17. An apparatus for roll packing a compressible material in a roll packing machine having a radially collapsible mandrel, a compression roller proximate the mandrel and adjustable to vary the spacing therebetween, and a packing material dispenser, the apparatus comprising:

means for providing the mandrel in a non-collapsed position supported by at least one support bearing;

means for adjusting the spacing between the compression roller and the mandrel to obtain a desired compression of the compressible material;

means for directing compressible material between the mandrel and the compression roller such that compressible material can be wound upon the mandrel by rotating the mandrel;

means for rotating the mandrel to wind the compressible material onto the mandrel;

means for applying packing material to the compressible material as it is wound upon the mandrel;

means for stopping rotation of the mandrel when a desired quantity of compressible material has been wound onto the mandrel;

means for collapsing the mandrel to release the roll from the mandrel; and means for removing the roll of compressible material from the mandrel.

18. The apparatus of claim 7, wherein the roll handler is an elongated, through-shaped cradle pivotally mounted at a first end to support, whereby the cradle may be placed in a first position to be substantially aligned with the mandrel to receive a finished roll from the second end of the mandrel, and whereby the cradle may be pivoted to a second position to permit subsequent handling of the finished roll.

* * * * *

UNITED STATES PATENT AND TRADEMARK OFFICE

CERTIFICATE OF CORRECTION

PATENT NO. : 6,640,520 B2
DATED : November 4, 2003
INVENTOR(S) : Josip Gecic

It is certified that error appears in the above-identified patent and that said Letters Patent is hereby corrected as shown below:

Column 8,
Line 42, change “through-shaped” to -- trough-shaped --.
Line 54, change “end to support” to -- end to a support --.

Signed and Sealed this

Sixth Day of January, 2004

JAMES E. ROGAN
*Director of the United States Patent and Trademark Office*